United States Patent [19]

Kondo

[11] 4,022,433

[45] May 10, 1977

[54] PILE PRESS DRIVER

[76] Inventor: Yoshizi Kondo, 2923-11, Togasaki, Misato, Saitama, Japan

[22] Filed: Sept. 15, 1975

[21] Appl. No.: 613,345

[30] Foreign Application Priority Data

Sept. 24, 1974 Japan ..... 49-108843

[52] U.S. Cl. ..... 254/188; 61/53.5; 173/88

[51] Int. Cl.[2] ..... B66D 3/04

[58] Field of Search ..... 254/144, 188, 189; 61/53.5, 53; 175/19; 173/85, 86, 88, 89

[56] References Cited

UNITED STATES PATENTS

| | | | |
|---|---|---|---|
| 2,822,671 | 2/1958 | Dentz et al. | 173/88 |
| 3,314,241 | 4/1967 | Mayhall | 61/53.5 |
| 3,320,714 | 5/1967 | Barrett | 61/53.5 |
| 3,827,508 | 8/1974 | MacKinnon | 61/53.5 |
| 3,833,072 | 9/1974 | Bock | 61/53.5 |

*Primary Examiner*—L. J. Paperner
*Assistant Examiner*—Kenneth Noland
*Attorney, Agent, or Firm*—Merchant, Gould, Smith, Edell, Welter & Schmidt

[57] ABSTRACT

A pile press driver, wherein a composite sheave device is mounted on a leader suspended from a boom fitted to a crane carrying a winch; the composite sheave device is driven by the winch; the one side end portions of a plurality of output wire ropes fixed to the underside of the movable sheave block of said composite sheave device are turned upward by a plurality of reversion sheaves; when the movable sheave block is lifted through operation of the winch, the other side end portions of the output wire ropes connected to a pile through a pair of guide arms and a pile cap are brought down, thereby forcefully driving a pile into the ground.

10 Claims, 4 Drawing Figures

PILE PRESS DRIVER

This invention relates to a pile driver for forcefully driving a pile into the ground, which comprises a leader and support means for suspending the leader.

Pile drivers used to date include, for example, a vibratory pile diver, diesel pile hammer, steam pile hammer and drop hammer. However, the prior art pile drivers have been accompanied with the various drawbacks from the standpoint of work and safety that environmental pollutions such as vigorous shakings and boisterous noises take place, the operational range is small, difficulties are encountered in driving a pile if the ground has an irregular surface, operators have to work right below a heavy pile driver, and the pile driver is liable to fall down sometimes. Particularly in recent years, problems regarding the elimination of the above-mentioned environmetal pollutions accompanying pile driving and the maintenance of work safety have come to assume great importance. Accordingly, strong demand is made for developmment of a pile driver free from environmental pollutions and assuring great operation safety.

Attempts have been made to eliminate the above-mentioned shortcomings of the prior art pile drivers by using, for example, an earth auger or a continuous shield. However, all these attempts are found undesirably to result in low work efficiency and high operation cost. There have been proposed other processes such as the new auger method and the PIP method which characteristically consists in pouring, for example, a chemical solution, molten bentonite and mortar into the ground. The new auger method has the disadvantage of applying a variety of machines and techniques. The PIP method also has the defects that a new form of environmental pollution arises from the toxicity of the ground impregnant, and a pile driven into the ground inseparably sticks to the ground impregnant, failing to be easily pulled out.

The object of this invention is to provide a pile driver capable of efficiently driving a pile into the ground with little occurrence of shakings and noises and safety assured for operators.

This object is attained by providing a pile driver which comprises a leader; support means for suspending the leader; a composite sheave device mounted on the support means; a plurality of output wire ropes whose one side end portions are fitted to the output side of the composite sheave device; a plurality of reversion means mounted on the leader so as to turn upward the one side end portions of the output wire ropes extending downward from the output side of the composite sheave device; an engagement member connected to the other side ends of the output wire ropes so as to supply the pile with a downward-acting pressure resulting from the tension of the other side end portions of the output wire ropes caused by the pullup of said one side end portions of the output wire ropes; elevator means for vertical movement of the engagement member mounted on the leader so as to engage the engagement member with the pile or disengage it therefrom; and drive means for operating the composite sheave device for continuously driving the pile into the ground by the above-mentioned downward acting pressure.

According to the pile driver of this invention, the support means consists of a crane and a boom mounted thereon; the composite sheave device is provided with a stationary sheave block, movable sheave block and input wire rope extending from both sheave blocks to the composite sheave device-driving means; the reversion means are formed of a plurality of stationary reversion sheaves disposed at the lower part of the leader; the engagement member is a pile cap placed on the head of a pile being driven; the elevator means for vertical movement of the engagement member includes an oil pressure source carried on the crane, and an oil pressure jack and stationary and movable sheave blocks all mounted on the leader; and the composite sheave device-driving means is a winch mounted on the crane so as to take up the input wire rope. Therefore, the subject pile driver can be easily manufactured without providing any special member or means.

The subject pile driver may further be fitted with means for moving a pile upward and downward for its proper setting.

If the pile cap of the subject pile driver is provided with a cylindrical engagement member partitioned at the intermediate part and impressed with a downward-acting pressure by the output wire ropes and a weight or drop hammer suspended by a pile cap wire rope and received in the engagement member so as to vertically pass therethrough, then the rapid impingement of the weight or drop hammer on the partition wall by operation of the pile cap wire rope increases the downward acting pressure exerted by the output wire rope by that extend, thereby effecting the more forceful drive of a pile. Further, if the lower end of the leader is fitted with a chuck for grasping the head of a driven pile or any adjacent structure firmly fixed in the ground, then the floatation of the leader by an upward acting force applied thereto in driving the pile can be suppressed to enable said driving to be more effectively carried out.

The pile driver of this invention causes a pile to be continuously driven into the ground by the above-mentioned force exerted by the output wire ropes without applying any mechanical blow, thereby eliminating the generation of shakings or noises. Further, omission of a mechanical blow enables a pile, once set, to be silently driven into the ground along the leader by carrying out the driving operation on the crane at a point apart from the pile, thus saving operators from any danger.

Even where the impingement on a pile of a weight or drop hammer received in the cylindrical partitioned engagement member of the pile cap is carried out to apply an additional pressure, the resultant shakings or noises are not so noticeable. The reason is that the impingement of the weight is simply auxiliary and does not constitute a main function as in a prior art hammer type pile driver and that said impingement is carried out within said engagement member and the resultant noises are muffled therein.

This invention can be more fully understood from the following detailed description when taken in conjunction with the accompanying Drawing. Referring to the Drawing, wherein like numerals represent like parts throughout the several views.

Figure 1:
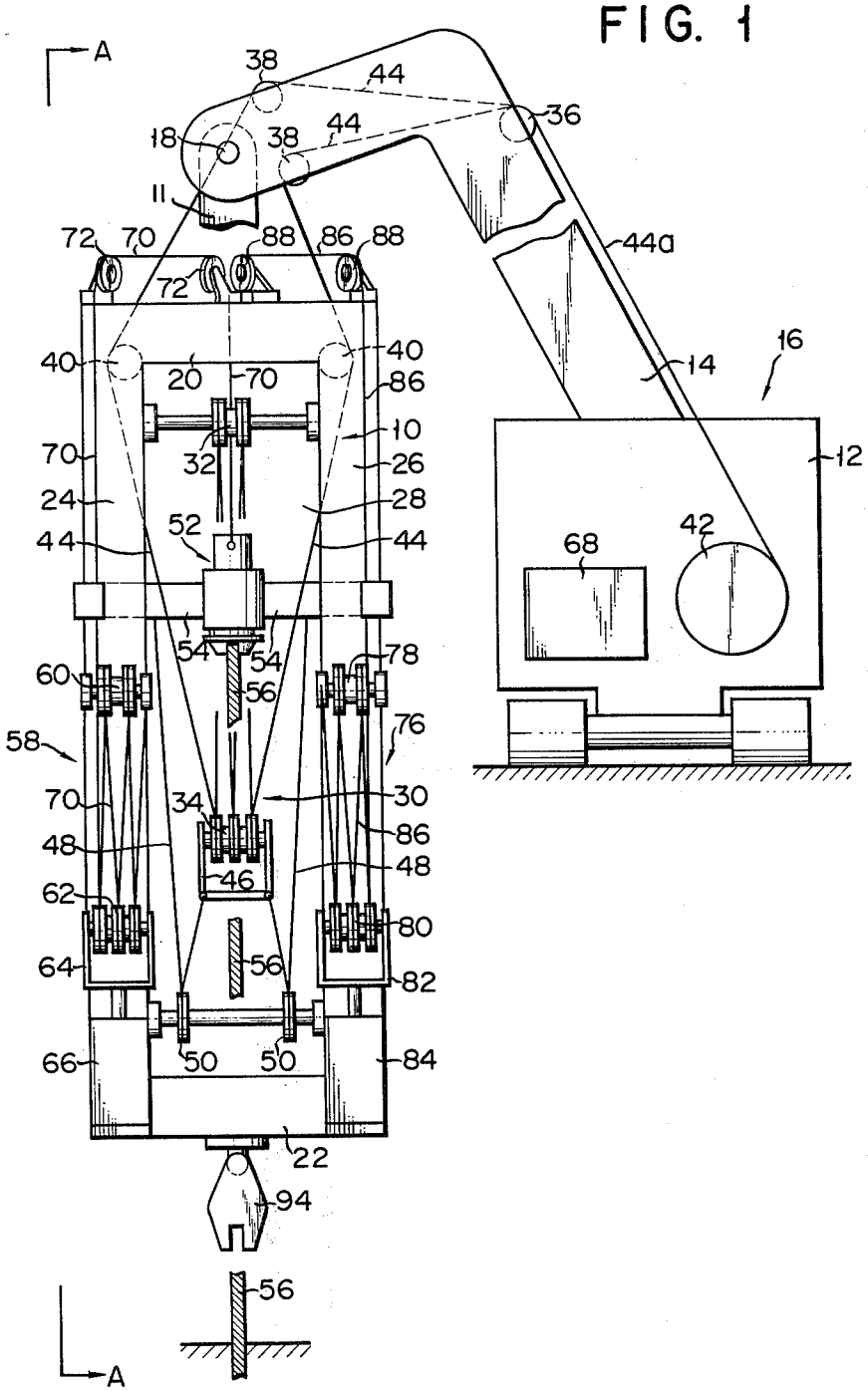
FIG. 1 is a front view of the pile driver of this invention, showing the leader and support means for suspending the leader on reduced scale.
Figure 2:
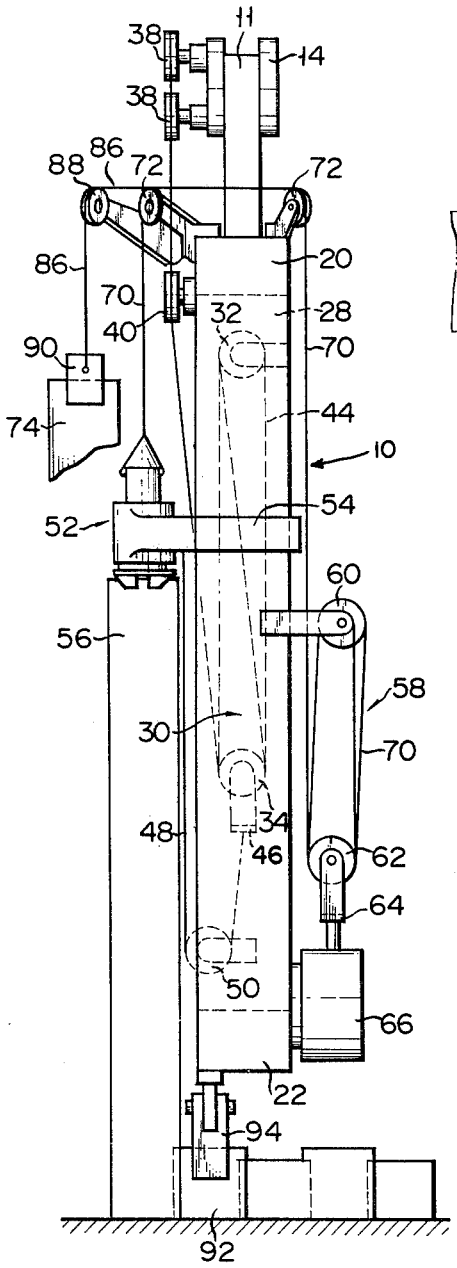
FIG. 2 is a side view of the leader on line A—A of FIG. 1.

Referring to FIGS. 1 and 2, referential numeral 10 denotes a leader. Support means 16 consists of a crane 12 and a boom 14 mounted thereon. The leader 10 is suspended from the forward end of the boom 14. Said suspension is effected by a projection 11 formed at the upper part of the leader 10 and a connection pin 18 pivotally supporting the projection 11 at the forward end of the boom 14.

Figure 3:
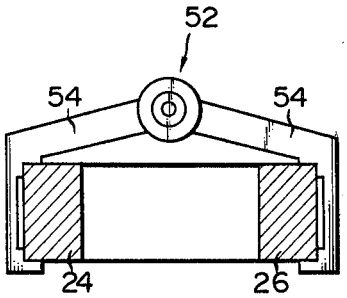
FIG. 3 is a plan view of pile cap guide means.

The leader 10 is formed of an upper frame 20, lower frame 22 and vertical frames 24, 26 (FIG. 1) with a window section 28 (FIG. 2) defined therebetween. A composite sheave device 30 received in the window section 28 comprises a stationary sheave block 32, movable sheave block 34, and single input wire rope 44 which passes over the stationary and movable sheave blocks 32, 34 and sheaves 36, 38, 40 and is finally taken up on a drive winch 42 carried on the crane 12. Two output wire ropes 48 whose one side ends are connected to a frame 46 belonging to the movable sheave block 34 pass over the corresponding reversion means or revision sheaves 50. The other side ends of said two output wire ropes 48 are connected to the corresponding paired guide arms 54 which extend from the engagement member or pile cap 52 so as to move the pile cap 52 vertically along the leader 10. FIG. 3 shows the pile cap 52 coupled to the paired guide arms 54 which vertically move in engagement with the vertical frames 24, 26.

The single input wire rope 44 taken up by the winch 42 at both end portions 44a (in FIG. 1 shown as being superposed to look as if only one rope) lifts the movable sheave block 34 through three pairs of sheaves 36, 38, 40 (in FIG. 1 the paired sheaves 36 are shown as being superposed). When, therefore, the output wire ropes 48, whose one side ends are connected to the frame 46 are brought down through the corresponding reversion sheaves 50, then the paired guide arms 54 connected to the other side ends of said output wire ropes 48 are also brought down together with the pile cap 52. If, in this case, the lower end portion of the pile cap 52 is made to engage the head of a pile 56 already set, then the downward movement of the pile cap 52 causes the pile 56 to be forcefully driven into the ground with very few shakings or noises. Elevator means 58 of the engagement member or pile cap 52 lifts the pile cap 52 up the leader 10 or places it on the head of the pile 56 already set. This pile cap elevator means 58 comprises an oil pressure source 68 (FIG. 1) carried on the crane 12; a stationary sheave block 60 and movable sheave block 62 and frame 64 belonging to the sheave block 62 all mounted on the leader 10; an oil pressure jack 66 driven by the oil pressure source 68 for vertical movement of the frame 64; and a pile cap wire rope 70. The pile cap wire rope 70 passes over the sheave blocks 60, 62 and top sheave 72 fitted to the upper frame 20, and extends downward to the rear side of the leader 10 in FIG. 1 (the left side thereof in FIG. 2) to be finally connected to the pile cap 52.

A fluid passageway connecting the oil pressure source 68 and oil pressure jack 66 together is built along the boom 14, a junction between the boom 14 and the leader 10 suspended therefrom and the leader 10, but is not indicated to avoid complication of illustration.

The pile cap 52 connected to the output wire ropes 48 and pile cap wire rope 70 has to be smoothly operated by proper control of the winch 42 and oil pressure jack 66 in effecting the vertical movement of the pile 56.

The leader 10 is provided with elevator means (FIG. 1) for setting a pile 74 (FIG. 2). The pile-setting elevator means 76 (FIG. 1) having substantially the same construction as the pile cap-elevator means 58 is described mainly by reference to FIG. 1. The pile-setting elevator means 76 comprises the oil pressure source 68 carried on the crane 12; a stationary sheave block 78, movable sheave block 80, and frame 82 belonging to said sheave block 80 all mounted on the leader; an oil pressure jack 84 driven by the oil pressure source 68 for vertical movement of the frame 82; and pile-setting wire rope 86. This pile-setting wire rope 86 passes upward over the sheave blocks 78, 80 and top sheave 88 and runs downward to the left side of the pile cap 52 (the rear side thereof in FIG. 1) to support the pile 74. Referential numeral 90 (FIG. 2) is a chuck fitted to the tip of the pile-setting wire rope 86 to hold the pile 74.

The pile 74 is set by being lifted in a state held by the chuck 90 through operation of the oil pressure jack 84 and having the lower end engaged with the head of another pile 92 already driven into the ground. The chuck 90 may consist of a known type such as a wedge chuck or friction chuck.

As shown in FIGS. 1 and 2, another chuck 94 is fitted to the underside of the lower frame 22 of the leader 10. Provision of this second chuck 94 is for the following reason. When the upper ends of the output wire ropes 48 fitted to the guide arms 54 are brought down by the lifting of the movable block 34 to drive the pile 56 (FIG. 1), then leader 10 itself is subjected to a sort of floatation through the paired reversion sheaves, if the drive of the pile 56 needs a considerable force, thus making it impossible to carry out said driving forcefully. If, in this case, the above-mentioned second chuck 94 is made to hold the head of the already driven pile 92 or other structure firmly fixed in the ground, then the floatation of the leader 10 is suppressed to attain the forceful driving of the pile 56. The chuck 94 may consist of a known type, such as a wedge chuck, friction chuck, oil chuck or pneumatic chuck.

Figure 4:
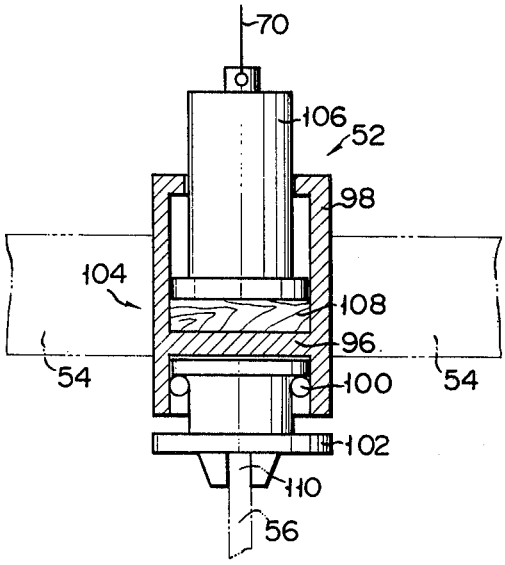
FIG. 4 is a fractional sectional view of a pile cap.

FIG. 4 shows the structure of the pile cap 52. This pile cap 52 comprises an engagement member 104 consisting of a partitioned cyclindrical cap body 98 provided with a portion wall 96 at the intermediate part on which a weight 106 impinges, if necessary (hereinafter referred to as "a weight impingement board") so as to divide the interior space of the cap body 98 into the upper and lower compartments and a cap head fitted into the lower compartment of the cap body 98 by fitting pins 100, and the weight 106 received in the upper compartment of the cap body 98 so as to axially move therethrough, and a cushion 108 disposed between the above-defined weight impingement board 96 and the bottom end face of the weight 106. The cap head 102 is bored on the underside with a groove 110 open downward for engagement with the head of a pile. The pile cap wire rope 70 is fitted to the top of the weight 106.

Where much higher pressure is required in driving the already set pile 56 with the pile cap 52 placed on the head thereof, then it is advised to drop only the weight 106 on the weight impingement board 96 rapidly as often as needed by the pile cap wire rope 70. Impingement of the weight 106 provides an additional pressure to the downward acting pressure applied to the pile 56 by the output wire ropes 48, enabling the pile 56 to be driven deeper into the ground with an increased force. Further, since the impingement of the weight 106 takes place in the interior of the cap body 98, very few shakings or noises propagate to the outside.

While the invention has been described with reference to a preferred embodiment, it will be understood that my invention is to be limited only by the scope of the appended claims.

What is claimed is:

1. A pile press driver for forcefully driving a pile into the ground which comprises: a leader; support means for suspending the leader; a composite sheave device carried on the leader and having an output side; a plurality of output wire ropes whose one side ends are connected to the output side of the composite sheave device; a plurality of reversion means mounted on the leader so as to turn upward the one side end portions of the output wire ropes extending downward from the output side of the composite sheave device; a pile cap connected to the other side ends of the output wire ropes and mountable on the head of a pile so as to supply the pile with a uniform downward acting pressure resulting from the tension of the entire output wire ropes caused by pulling upward the one side end portions of the output wire ropes through operation of the composite sheave device; pile cap elevator means for vertically moving the pile cap carried on the leader so as to selectively engage and disengage the pile cap with the pile; and drive means for uniformly driving the composite sheave device so as to continuously drive the pile into the ground by the aforesaid downward acting pressure.

2. The pile press driver according to claim 1, wherein the support means for suspending the leader includes a crane and a boom mounted thereon; wherein the composite sheave device includes a stationary sheave block, a movable sheave block and an input wire rope extending from both sheave blocks to the drive means; wherein the reversion means comprise a plurality of stationary reversion sheaves afixed to the underside of the leader; wherein the pile cap elevator means comprises an oil pressure source carried on said crane, an oil pressure jack attached to said leader and driven by said oil pressure source, a movable sheave block driven by said oil pressure jack so as to move, a stationary sheave block attached to said leader so as to cooperate with said movable sheave block, and a pile cap wire rope trained over both sheave blocks and having its one end connected to said pile cap; and wherein the drive means comprises a winch carried on the crane so as to take up the input wire rope.

3. The pile press driver according to claim 2, which further comprises pile cap guiding means for vertically moving the pile cap along the leader.

4. The pile press driver according to claim 3, wherein the pile cap guiding means comprises a pair of guide arms extending from the pile cap and sliding in engagement with the leader.

5. The pile press driver according to claim 2, which further comprises pile-setting elevator means mounted on the leader so as to vertically move the pile for its proper setting.

6. The pile press driver according to claim 5, wherein the pile-setting elevator means includes an oil pressure source carried on said crane, an oil pressure jack attached to said leader and driven by said oil pressure source so as to move, a movable sheave block driven by said oil pressure jack so as to move, a stationary sheave block attached to said leader so as to cooperate with said movable sheave block, and a pile-setting wire rope extending through both sheave blocks and having its one end connected to said pile cap, whereby said pile-setting elevator means sets the pile attached to said pile cap in its desired driving position.

7. A pile press driver according to claim 2, wherein the pile cap comprises a weight member and an engagement member subjected to a downward-acting pressure exerted by the output wire ropes and said weight, wherein said weight is received in the engagement member in a state suspended by the pile cap wire rope so as to vertically move therethrough.

8. The pile press driver according to claim 2, which further comprises a chuck fitted to the underside of the leader so as to hold a structure firmly fixed in the ground adjacent to the spot where a pile is driven.

9. A pile press driver for continuously forcefully driving a pile into the ground, comprising:

a. a leader member;

b. support means for suspending said leader member above the ground;

c. a pile cap member movably mounted on said leader suitable for engaging a head of a pile for exerting downward driving pressure thereto;

d. at least one sheave device mounted on said leader;

e. cable means cooperatively engaging said sheave device and operatively connected with said pile cap member for exerting continuous uniform downward driving pressure to said pile cap member in response to tension exerting forces applied to said cable means, said cable means having a first cable end operatively connected to said pile cap member and a second cable end to which tension exerting forces are applied; said downward driving pressure exerted by said pile cap member being proportional to the tension exerting forces applied to the second end of said cable means; and f. drive means operatively connected to said second end of said cable means for controllably applying tension forces to said cable means, to uniformly continuously drive a pile engaged by said pile cap member into the ground.

10. A pile press driver as recited in claim 9, further including elevator means mounted to said leader member and operatively connected to said pile cap member for selectively raising and lowering said pile cap member into operative engagement with the head of an underlying pile.

* * * * *